US007102139B2

(12) United States Patent
Low et al.

(10) Patent No.: US 7,102,139 B2
(45) Date of Patent: Sep. 5, 2006

(54) SOURCE ARC CHAMBER FOR ION IMPLANTER HAVING REPELLER ELECTRODE MOUNTED TO EXTERNAL INSULATOR

(75) Inventors: Russell J. Low, Rowley, MA (US); Eric R. Cobb, Danvers, MA (US); Joseph C. Olson, Beverly, MA (US); Leo V. Klos, Newburyport, MA (US)

(73) Assignee: Varian Semiconductor Equipment Associates, Inc., Gloucester, MA (US)

( * ) Notice: Subject to any disclaimer, the term of this patent is extended or adjusted under 35 U.S.C. 154(b) by 0 days.

(21) Appl. No.: 11/044,659

(22) Filed: Jan. 27, 2005

(65) Prior Publication Data

US 2006/0163489 A1 Jul. 27, 2006

(51) Int. Cl.
*H01J 7/24* (2006.01)

(52) U.S. Cl. ..... 250/426; 250/423 R; 250/429.21; 250/427; 315/111.81

(58) Field of Classification Search ..... None
See application file for complete search history.

(56) References Cited

U.S. PATENT DOCUMENTS 5,517,077 A 5/1996 Bright et al. ..... 313/359.1
5,763,890 A 6/1998 Cloutier et al. ..... 250/427
5,886,355 A * 3/1999 Bright et al. ..... 250/492.21
5,920,076 A 7/1999 Burgin et al. ..... 250/492.21
6,768,121 B1 * 7/2004 Horsky et al. ..... 250/427
2005/0173651 A1 * 8/2005 Goldberg et al. ..... 250/426

* cited by examiner

*Primary Examiner*—John R. Lee
*Assistant Examiner*—Zia R. Hashmi

(57) ABSTRACT

An ion implanter has a source arc chamber including a conductive end wall at a repeller end of the arc chamber, the end wall having a central portion surrounding an opening. A ceramic insulator is secured to an outer surface of the end wall, such as by peripheral screw threads engaging mating threads at the periphery of a recessed area of the end wall. A conductive repeller has a narrow shaft secured to the insulator and extending through the end wall opening, and a body disposed within the source arc chamber adjacent to the end wall. The end wall, insulator and repeller are configured to form a continuous vacuum gap between the central portion of the end wall and (i) the repeller body, (ii) the repeller shaft, and (iii) the insulator. The insulator interior surface can have a ridged cross section.

12 Claims, 4 Drawing Sheets

SOURCE ARC CHAMBER FOR ION IMPLANTER HAVING REPELLER ELECTRODE MOUNTED TO EXTERNAL INSULATOR

BACKGROUND

The present invention is related to the field of ion implanters for use in semiconductor manufacturing.

Ion implanters used in semiconductor manufacturing include a source arc chamber in which an electrical discharge interacts with a gas to create a plasma containing a variety of ion species, including a desired species to be implanted in the surface of a semiconductor wafer. The positive ions are extracted from the source arc chamber in a known manner, and apparatus within the implanter separates the desired species from the undesired species and directs the desired species to the surface of the wafer at a desired energy level.

In one common configuration, the source arc chamber includes an emitter electrode at one end and a repeller electrode at the other end. The emitter electrode may be a cathode heated by a filament, or simply a bare filament, and its purpose is to emit electrons by thermionic emission during operation. The electrons are accelerated into the arc chamber by a relatively positive arc voltage on the arc chamber walls, and an externally generated magnetic field causes the electrons to travel a spiral path into the arc chamber. The emitter and repeller electrodes are typically biased negatively with respect to the walls of the arc chamber. The combined effect of the emitter and repeller electrodes is to concentrate electrons toward the center of the arc chamber to maximize interaction with the gas and thereby attain a desired operational efficiency.

In one known configuration, the repeller has a broad portion that faces the center of the arc chamber, and a narrower shaft that extends outside the arc chamber through an opening in the arc chamber end wall. A ceramic insulator is disposed in the arc chamber between the end wall and the repeller to maintain the required electrical isolation.

During operation, the source arc chamber contains a host of molecular species at very high temperatures. Components in this harsh environment are subjected to conditions that may unduly limit their lifetime or their effectiveness, thus limiting the effectiveness and/or increasing the operating costs of the implanter. For example, there is a tendency for films of conductive material to be deposited on the interior arc chamber surfaces, including for example the surface of the ceramic insulator on which the repeller is mounted. This coating leads to electrical breakdown, which in turn leads to burn marks referred to as "track marks" or "tracking" on the ceramic and coating. Excessive electrical breakdown can interfere with normal operation of the implanter. There are other failure modes involving deposited material and the repeller insulator as well.

It is known to remove the repeller insulator outside of the arc chamber so as to reduce the formation of a conductive film and increase the lifetime of the source. In one such configuration, the outer end of the repeller is held in place by a cantilevered arm that is secured to other structure of the implanter by an insulator component. The repeller is held in a position in which its shaft passes through the end wall opening without touching it. In this configuration, the insulator is essentially shielded from any buildup of a conductive film by the arc chamber walls themselves. An ion implanter employing such a configuration is described in U.S. Pat. No. 5,517,077 of Bright et al.

SUMMARY

A repeller mounting configuration such as described above may adversely affect the efficiency of the source during operation. The repeller retaining arm and associated structure act as a heat sink, channeling heat away from the source arc chamber. As a result, the arc chamber runs cooler than it might otherwise, reducing fractionation and therefore source efficiency.

In accordance with the present invention, an ion implanter having a source arc chamber with an improved repeller mounting is disclosed. The improved repeller mounting provides for protection of the repeller insulator from the harsh environment of the arc chamber, promoting greater source life, without requiring a mechanical coupling to external mounting structure that can act as an undesirable heat sink.

The source arc chamber includes a conductive end wall at a repeller end of the arc chamber, the end wall having a central portion surrounding an opening. An insulator is secured to an outer surface of the end wall, such as by peripheral screw threads that engage mating threads formed at the periphery of a recessed area of the end wall, and has a central portion at the opening of the end wall. A conductive repeller has a narrow shaft and a broad body, the shaft being secured to the central portion of the insulator and extending through the opening of the end wall, and the body being disposed within the source arc chamber adjacent to the end wall. The central portion of the end wall, the insulator and the repeller are mutually configured such that a continuous vacuum gap exists between the central portion of the end wall and (i) an adjacent surface of the body of the repeller, (ii) an adjacent surface of the shaft of the repeller, and (iii) an adjacent surface of the central portion of the insulator.

By the above configuration, the repeller body and to some extent the central portion of the end wall provide a shadowing effect that shields the insulator from the plasma within the arc chamber, thus reducing damage to the insulator during operation. Additionally, the buildup of material on the surface of the insulator is reduced as compared to prior repeller mounting configurations. The effective length of the insulator surface can also be increased substantially by employing a ridged cross section on the interior surface of the insulator facing the central portion of the end wall, further inhibiting tracking. Because the repeller is mounted directly to the end wall of the arc chamber, the heat sink effect of prior repeller configurations is avoided.

BRIEF DESCRIPTION OF THE SEVERAL VIEWS OF THE DRAWING

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, with emphasis instead being placed upon illustrating the embodiments, principles and concepts of the invention.

DETAILED DESCRIPTION

Figure 1:
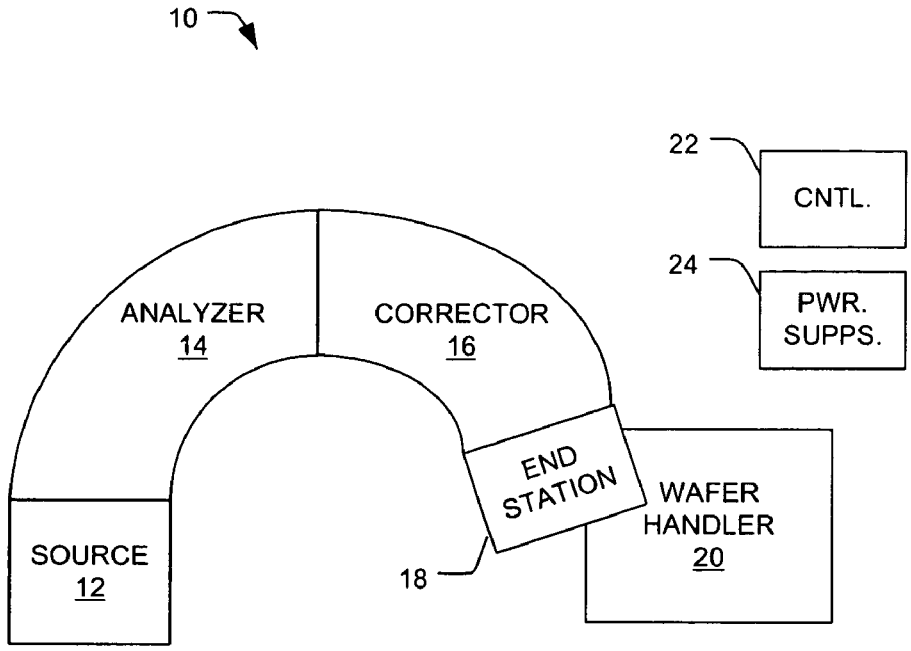
FIG. 1 is a schematic representation of an ion implanter in accordance with the present invention.

FIG. 1 shows an ion implanter 10 including a source module 12, analyzer module 14, corrector (CORR) module 16, and end station 18. Immediately adjacent to the end station 18 is a wafer handler 20. Also included are control circuitry (CNTL) 22 and power supplies (PWR SUPPS) 24, which although shown in respective blocks in FIG. 1 are actually distributed throughout the ion implanter 10 as known to those in the art.

During an implantation operation, the source module 12 is fed with a gaseous compound including the element(s) to be implanted into a semiconductor wafer. As an example, for the implantation of boron (B), gaseous boron fluoride ($BF_3$) is supplied to the source module 12. The source module 12 employs electrical excitation to form a plasma that generally includes a number of ion species resulting from fractionation of the source compound, including the desired species (e.g., $B^+$) that is to be implanted. As the source module 12 is biased to a relatively positive potential, the positively charged ion species are extracted from the source module 12 by acceleration out to ground potential, which is negative with respect to the positively biased source module 12. The extracted ion species form the initial part of an ion beam that enters the analyzer module 14.

The analyzer module 14 includes a large, powerful magnet that imparts a bend to the source ion beam portion from the source module 12. The amount of bend varies slightly for the different ion species of the beam, owing to their generally different atomic weights. Thus, as the beam travels toward the corrector module 16 through the analyzer module 14, it spreads out due to the different trajectories of the different ion species. At the exit end, the analyzer module 14 has a resolving slit or opening (not shown in FIG. 1) through which only the species of interest (e.g., $B^+$) passes, while the other species are collected by a conductive plate surrounding the resolving opening. Thus, at the exit of the analyzer module 14, the ion beam consists almost exclusively of the desired ion species.

The corrector module 16 is used to shape the beam. In one embodiment, the end station 18 includes mechanical wafer scanning apparatus (not shown) that scans a wafer across the beam (which is stationary) to effect the implantation. The wafer handler 20 is a clean, robotic mechanical system for transferring wafers between a human operator of the system and the scanning apparatus.

Figure 2:
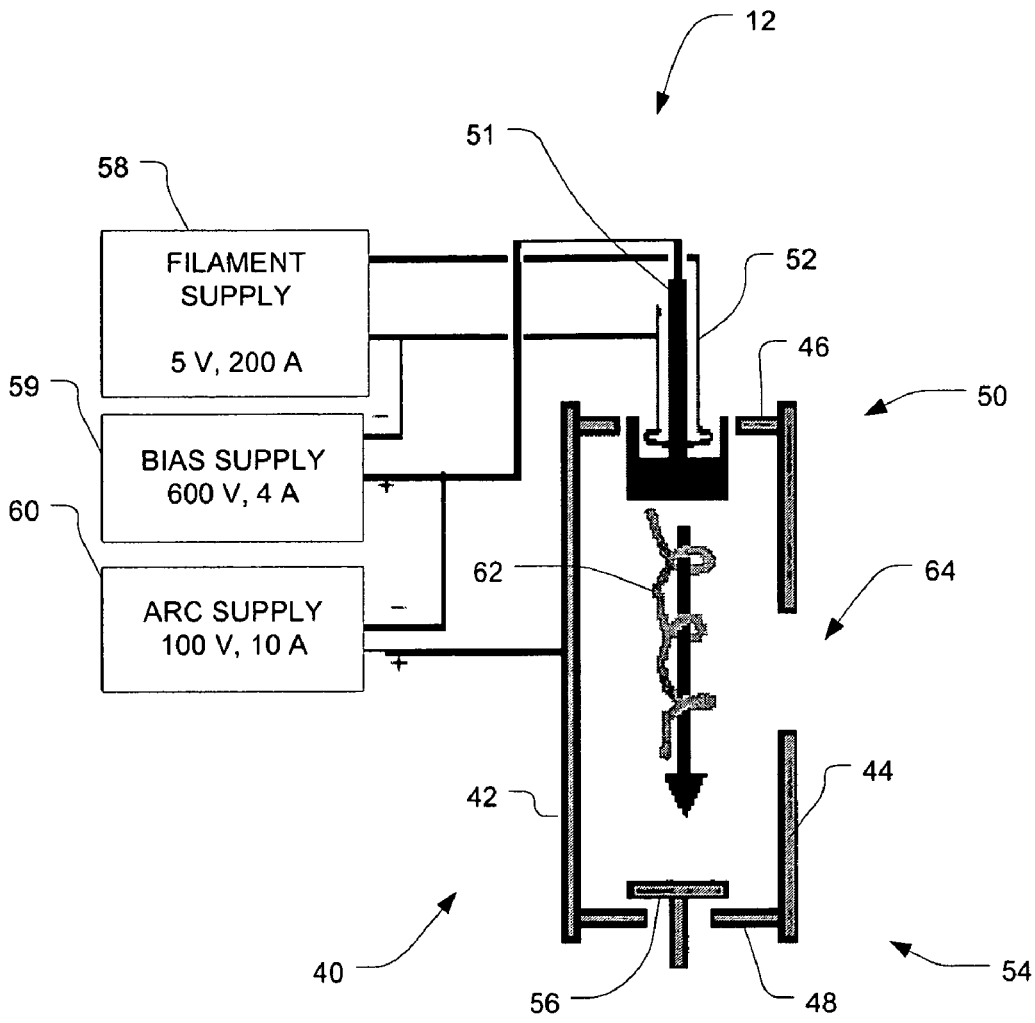
FIG. 2 is a schematic diagram of a source arc chamber of the ion implanter of FIG. 1.

FIG. 2 is a schematic illustration of the source module 12 of the ion implanter 10. A source arc chamber 40 includes conductive side walls 42, 44 and conductive end walls 46, 48. At a first end of the source arc chamber 40, referred to herein as the cathode end 50, a cathode 51 heated by a separate filament 52 extends though an opening of the end wall 46. At the opposite end of the source arc chamber 40, referred to herein as the repeller end 54, a repeller electrode or repeller 56 (typically made of tungsten) extends through an opening of the end wall 48.

As shown, the filament 52 is connected to a filament power supply 58, and a bias power supply 59 is connected between the filament 52 and the cathode 51. An arc power supply 60 is connected between the cathode 51 and the walls 42–48 of the source arc chamber 40. In the illustrated embodiment, the filament power supply 58 is a 5 volt, 200 ampere power supply, the bias supply 59 is a 4 ampere, 600 volt power supply, and the arc power supply 60 is a 100 volt, 10 ampere power supply.

The repeller 56 may be either of two broad types, either floating or connected to the same potential as the cathode 51. As known in the art, a floating repeller typically floats at the potential of the plasma, which is close to the arc voltage potential. A cathode-tied repeller takes on the arc voltage potential.

In operation, the filament 52 is heated by current from the filament power supply 58 and in turn heats the cathode 51, via electron bombardment, to the point of thermionic emission of electrons. The electrons are attracted away from the cathode 51 toward the interior of the source arc chamber 40 by an electric field created by the arc supply voltage appearing on the walls 42–48. An external source magnet (not shown) creates a magnetic field within the source arc chamber 40, such that the combined effects of the magnetic field and the electric field cause the electrons to travel along a spiral path 62 toward the repeller end 54 of the source arc chamber 40. The electrons are repelled by the negative potential of the repeller 56 as well as that of the cathode 51, and thus are concentrated toward the center of the source arc chamber 40, where they interact with a precursor gas to form a plasma containing various species of positive ions. These ions are extracted from the source arc chamber 40 via an extraction opening 64 by operation of a relatively negatively biased extraction electrode (not shown). As is known in the art, the extracted ions form the initial part of an ion beam that travels through various other stages of the ion implanter 10 before striking a semiconductor wafer to implant a species of interest.

Figure 3:
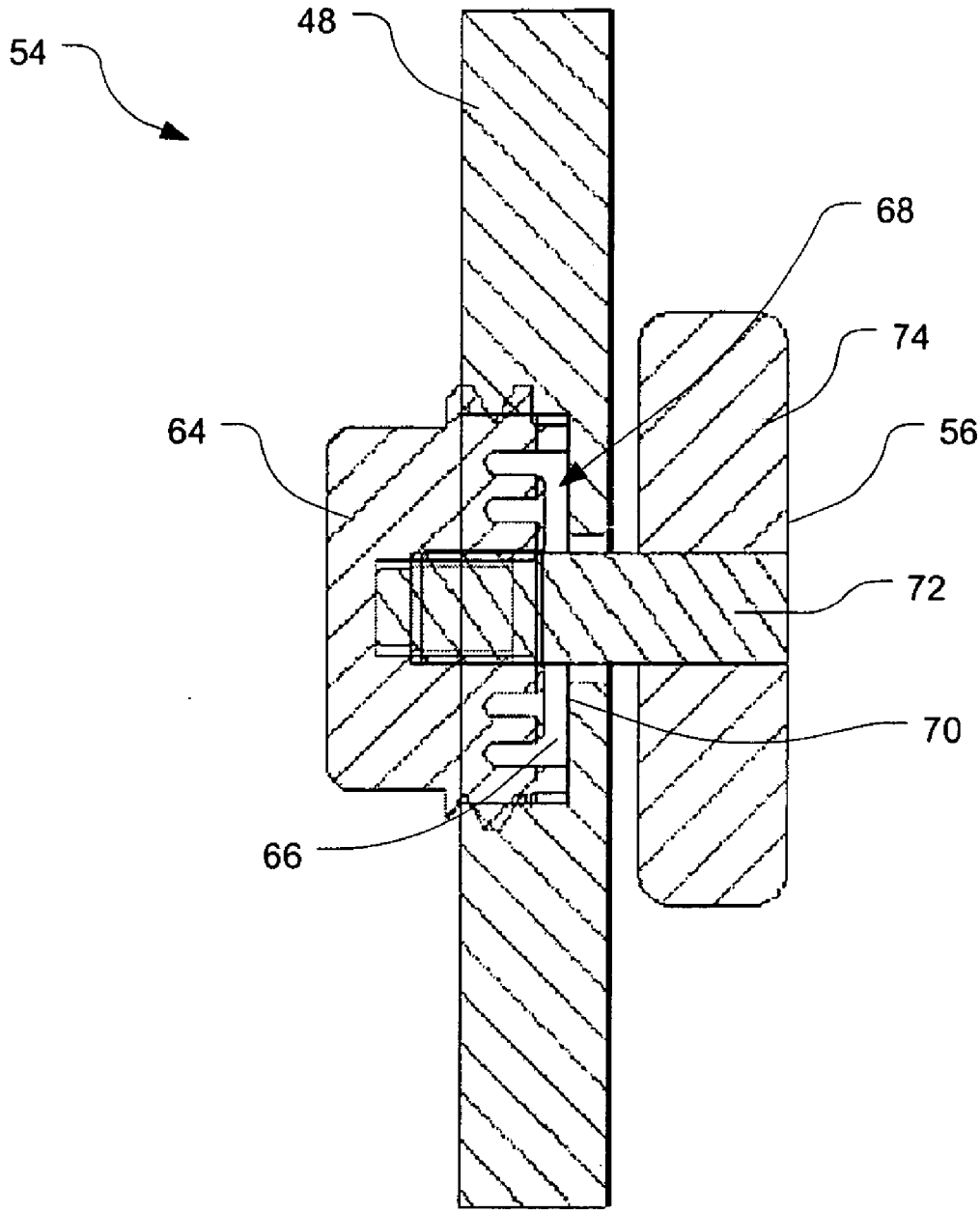
FIG. 3 is a section side view of a repeller end of the source arc chamber of FIG. 2, including a repeller electrode and external insulator.

FIG. 3 shows a side section view of the repeller end 54 of the source arc chamber 40. A knob-like insulator 64 of a ceramic material (e.g. aluminum oxide) is secured to the exterior of the end wall 48, in particular to a central portion of the end wall 48 in a recessed area 66. In the illustrated embodiment, the insulator 64 is secured in the recessed area 66 by peripheral screw threads, as described in more detail below. An interior surface 68 of the insulator 64 has a ridged profile and is spaced apart from an opposing surface 70 of the recessed area 66. The repeller 56 has a narrow shaft 72 and a broader body 74 which extends into the interior of the source arc chamber 40. In one embodiment, the diameter of the shaft 72 is 0.125", and the diameter of the body 74 is in the range of 0.8" to 1".

The other end of the shaft 72 extends into the insulator 64 and is secured thereto, for example by screw threads. As a result, the repeller 56 is held rigidly by the insulator 64 in an electrically insulating, spaced-apart relationship with the end wall 48. In one embodiment, the screw threads of the repeller shaft 72 are of the opposite type of the peripheral screw threads of the insulator 64 that secure it to the end wall 48. For example, the peripheral screw threads of the insulator 64 may be right-hand threads, and the screw threads of the repeller shaft 72 may be left-hand threads. With such a configuration, the tightening of the repeller 56 in the insulator 64 during assembly reinforces the attachment of the insulator 64 to the end wall 48, rather than acting against it.

During operation of the source arc chamber 40, ions from the high-energy plasma within the arc chamber 40 are largely prevented from reaching the insulator 64 by a shadowing effect of the repeller body 70. As described above, this greatly reduces degradation of the insulator 64 over time, and thus increases its lifetime. Additionally, as described in more detail below, the external placement of the insulator also reduces the buildup of dust-like material on the surface of the insulator 64 that can create a short-circuit path between the repeller 56 and the end wall 48 of the arc chamber 40.

Figure 4:
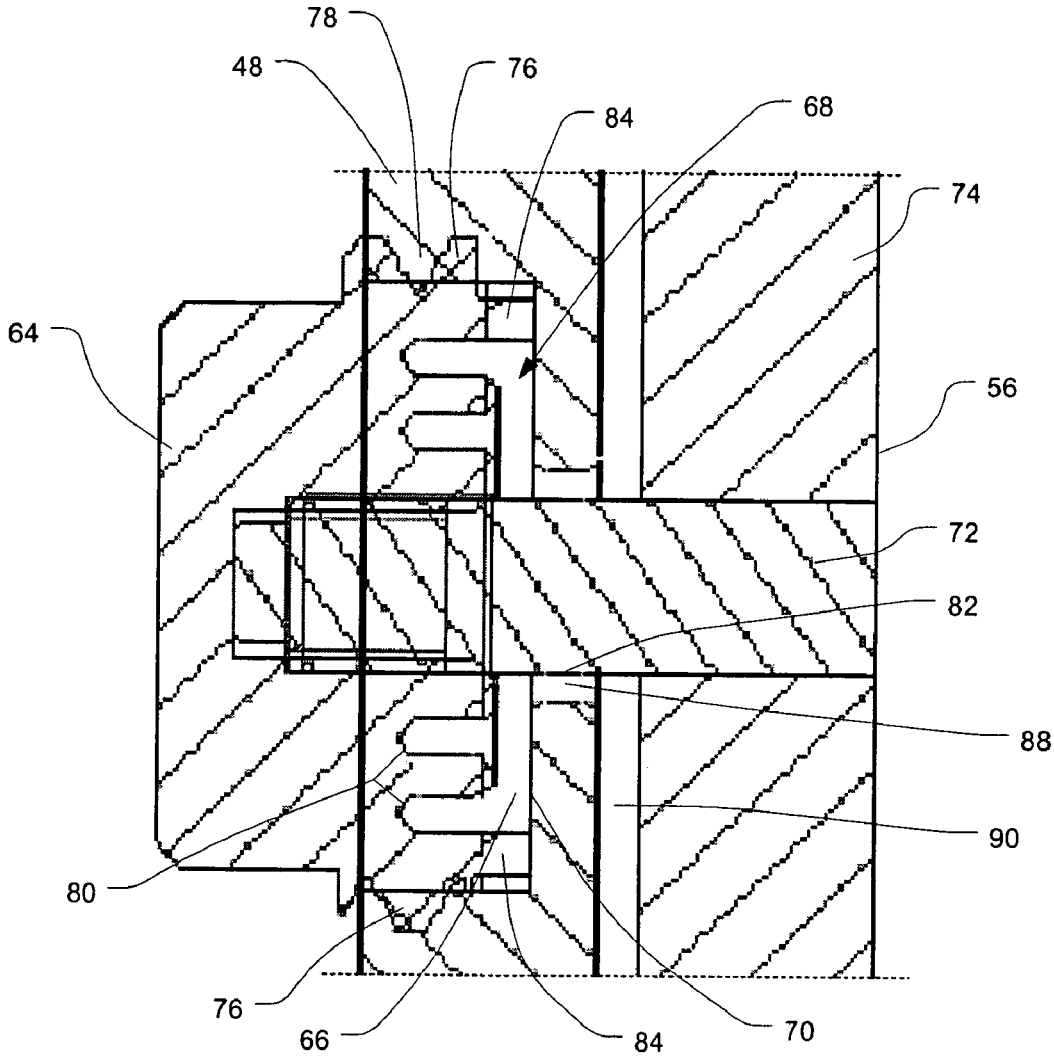
FIG. 4 is a blown up view of a central portion of the source arc chamber repeller end of FIG. 3.

FIG. 4 shows the central portion of the end wall 48 in greater detail. The insulator 64 has screw threads 76 on its perimeter that mate with corresponding screw threads 78 on the perimeter of the recessed area 66 of the end wall 48. The inward-facing surface 68 of the insulator 64 has ridges 80 to provide a long radial path across the insulator 64 between the surface 82 of the repeller shaft 72 and the surface 70 of the end wall recessed area 66. It has been observed that the buildup of debris on the surface of prior-art repeller insulators generally proceeds across the insulator with time, a process referred to as "tracking". Because the effective length of the insulator surface is increased substantially when ridges such as ridges 80 are employed versus a flat surface, it takes correspondingly longer for the debris buildup to track across the entire insulator surface to create a short-circuit path. Thus, the lifetime of the source arc chamber 40 and preventive maintenance cycle time are both increased.

The insulator 64 includes an outer standoff ridge 84 that is longer than the other ridges 80. This outer standoff ridge 84 serves to maintain a vacuum gap between the interior surface 68 of the insulator 64 and the surface 70 of the countersunk area 66 of the end wall 48. The vacuum gap is part of a continuous vacuum gap that includes vacuum gap 88 between the repeller shaft 72 and a central portion of the end wall 48, and vacuum gap 90 between the repeller body 74 and the end wall 48. In the illustrated embodiment, the vacuum gaps 88 and 90 preferably are in the range of 0.02" to 0.04" wide, to obtain the desired electrical isolation while minimizing gas leakage and conductance.

In alternative embodiments, the insulator 64 may be secured to the end wall 48 of the source arc chamber 40 in other ways. For example, it may be desirable to dispense with the recessed area 66, or to use a fastening scheme other than mating screw threads (such as press-fitting, for example).

Alternative materials for the repeller 56 include boron nitride, alumina, and glass. Also, the repeller body and/or shaft may have other than a circular shape/cross-section, such as oval or square.

Those skilled in the art will appreciate that embodiments and variations of the present invention other than those explicitly disclosed herein are possible. It is to be understood that modifications to the methods and apparatus disclosed herein are possible while still achieving the objectives of the invention, and such modifications and variations are within the scope of this invention. Accordingly, the scope of the present invention is not to be limited by the foregoing description of embodiments of the invention, but rather only by the claims appearing below.

What is claimed is:

1. A source arc chamber for an ion implanter, comprising:

a conductive end wall at a repeller end of the source arc chamber, the end wall having a central portion surrounding an opening;

an insulator mounted directly to an outer surface of the end wall, the insulator having a central portion at the opening of the end wall; and a conductive repeller having a narrow shaft and a broad body, the shaft being secured to the central portion of the insulator and extending through the opening of the end wall, the body being disposed within the source arc chamber adjacent to the end wall, wherein the central portion of the end wall, the insulator and the repeller are mutually configured such that a continuous vacuum gap exists between the central portion of the end wall and (i) an adjacent surface of the body of the repeller, (ii) an adjacent surface of the shaft of the repeller, and (iii) an adjacent surface of the central portion of the insulator.

2. A source arc chamber according to claim 1, wherein the surface of the central portion of the insulator adjacent to the central portion of the end wall has a rigid cross section.

3. A source arc chamber according to claim 1, wherein the central portion of the end wall has a recessed area in which the insulator is disposed.

4. A source arc chamber according to claim 3, wherein a perimeter of the insulator is mounted to a perimeter of the recessed area of the end wall.

5. A source arc chamber according to claim 4, wherein the perimeters of the insulator and the recessed area of the end wall are configured with mating screw threads by which the insulator is mounted to the end wall.

6. A source arc chamber according to claim 1, wherein the central portion of the end wall has a recessed area, a perimeter of the recessed area and a perimeter of the insulator of the end wall are configured with first mating screw threads by which the insulator is mounted to the end wall, the first mating screw threads being tightened upon rotation of the insulator about a rotational axis in a first direction, and wherein the shaft of the repeller and the central portion of the insulator are configured with second mating screw threads by which the repeller is secured to the insulator, the second mating screw threads being tightened upon rotation of the repeller about the rotational axis in a second direction opposite the first direction.

7. A source arc chamber according to claim 1, wherein the surface of the central portion of the insulator adjacent to the central portion of the end wall has a ridged cross section, and further comprising a shield disposed between the central portion of the insulator and the central portion of the end wall, the shield having a correspondingly ridged cross section spaced from and interdigitated with the ridged cross section of the central portion of the insulator.

8. A source arc chamber according to claim 1, wherein the insulator comprises a ceramic material.

9. A source arc chamber according to claim 8, wherein the ceramic material consists essentially of aluminum oxide.

10. A source arc chamber according to claim 1, wherein the vacuum gap is in the range of 0.02" to 0.04" wide between the end wall of the chamber and both (i) the repeller shaft and (ii) the repeller body.

11. A source arc chamber according to claim 1, wherein the repeller is floating.

12. A source arc chamber according to claim 1, further comprising a cathode at a cathode end of the chamber, and wherein the repeller is tied to the same potential as the cathode.

* * * * *